United States Patent [19]

Kraus et al.

[11] 3,945,704

[45] Mar. 23, 1976

[54] DEVICE FOR DETECTING AN APPLIED COMPRESSIVE LOAD

[76] Inventors: Robert A. Kraus, 14160 Red Hill Blvd, Tustin, Calif. 92680; Edmund J. Kraus, 2601 Orion, Santa Ana, Calif. 92704

[22] Filed: Mar. 28, 1974

[21] Appl. No.: 455,637

[52] U.S. Cl. ..... 339/97 C; 85/62; 73/88 F; 339/113 L; 340/421

[51] Int. Cl.[2] ..... H01R 9/08

[58] Field of Search ..... 339/95, 97–99, 339/113; 85/62; 73/88 F; 116/DIG. 34; 340/267 R, 421; 318/488

[56] References Cited

UNITED STATES PATENTS

| | | | |
|---|---|---|---|
| 2,648,883 | 8/1953 | Wilson et al. | 340/421 |
| 3,588,787 | 6/1971 | Kindell et al. | 339/95 A |
| 3,623,360 | 11/1971 | Paine | 73/88 F |
| 3,696,412 | 10/1972 | Swanson | 85/62 |
| 3,719,919 | 3/1973 | Tibolla | 339/95 A |
| 3,740,685 | 6/1973 | Fisher | 339/95 A |

FOREIGN PATENTS OR APPLICATIONS

| | | | |
|---|---|---|---|
| 459,910 | 9/1949 | Canada | 339/97 R |
| 1,024,525 | 3/1966 | United Kingdom | 339/95 A |

*Primary Examiner*—Joseph H. McGlynn
*Attorney, Agent, or Firm*—Donald D. Mon

[57] ABSTRACT

A one-shot device for detecting the application of a compressive load of predetermined amount which includes a first and a second electrically conductive metallic member, each of which has a substantially planar face. The first member is made of a material which is harder and less ductile than the material of the second member. A brittle insulation layer is sandwiched between the faces. A wall recedes from the first face partially to define an open region adjacent to the first face. When the members are pressed toward one another under a load of said predetermined amount, the insulation layer fractures abruptly at the wall, and material of one of the members moves to make contact at the wall with the other member so as to signal application of the predetermined force. This change of conductive condition can be utilized to complete an electrical circuit for indication and control purposes.

26 Claims, 11 Drawing Figures

POWER CONTROL RELAY
WRENCH MOTOR

DEVICE FOR DETECTING AN APPLIED COMPRESSIVE LOAD

This invention relates to a device for detecting the attainment of a predetermined load. It is a device of broad application, but is expected to find its primary utility in combination with tension-type fasteners, such as nut and bolt combinations, so as to indicate the application of a predetermined axial preload in the fastener.

Tension-type fasteners are required to be set to a predetermined torque, principally because the torque is regarded as being proportional to the axial preload—that is to say, axial tension—of the fastener which is responsible for the clamping together of the workpiece.

In high performance fasteners, the axial preload in the fastener is a matter of considerable importance, and it is better to measure it directly as a compressive value than it is to measure it indirectly through the measurement of torque. Also, structural joints which utilize threaded fasteners are commonly set in production operations at a rapid rate. It is difficult to attain close control and repeatability in rapid production with the use of torque wrenches.

It is an object of this invention to provide means for detecting a predetermined axial preload and to utilize this detection capability as means to indicate the fact that the preload has been exerted, or as means to control the tool which applies the torque that generates the preload. The torquing operation can then readily be terminated after the attainment of the desired preload.

A device according to this invention comprises a first and a second electrically conductive metallic member which have a respective first and second substantially planar face. The material of the first member is harder and less ductile than the material of the second member. A wall recedes from the first face. A flat insulation layer is disposed between the faces. The material of the insulation layer is hard and brittle. When the members are pressed toward one another under a load of the predetermined amount, the insulation layer will abruptly fracture adjacent to the wall, and a portion of one of the members will move to contact the other. This exposes insulation-free material of both members to each other. The members then can make a direct electrically conductive contact with one another adjacent to the said boundary, and this contact can be used to complete an electrical circuit for indication and control purposes.

The above and other features of this invention will be fully understood from the following detailed description and the accompanying drawings in which.

Figures 1, 2, 3, 4, 5, 6, 7, 8, 9, 10, 11:
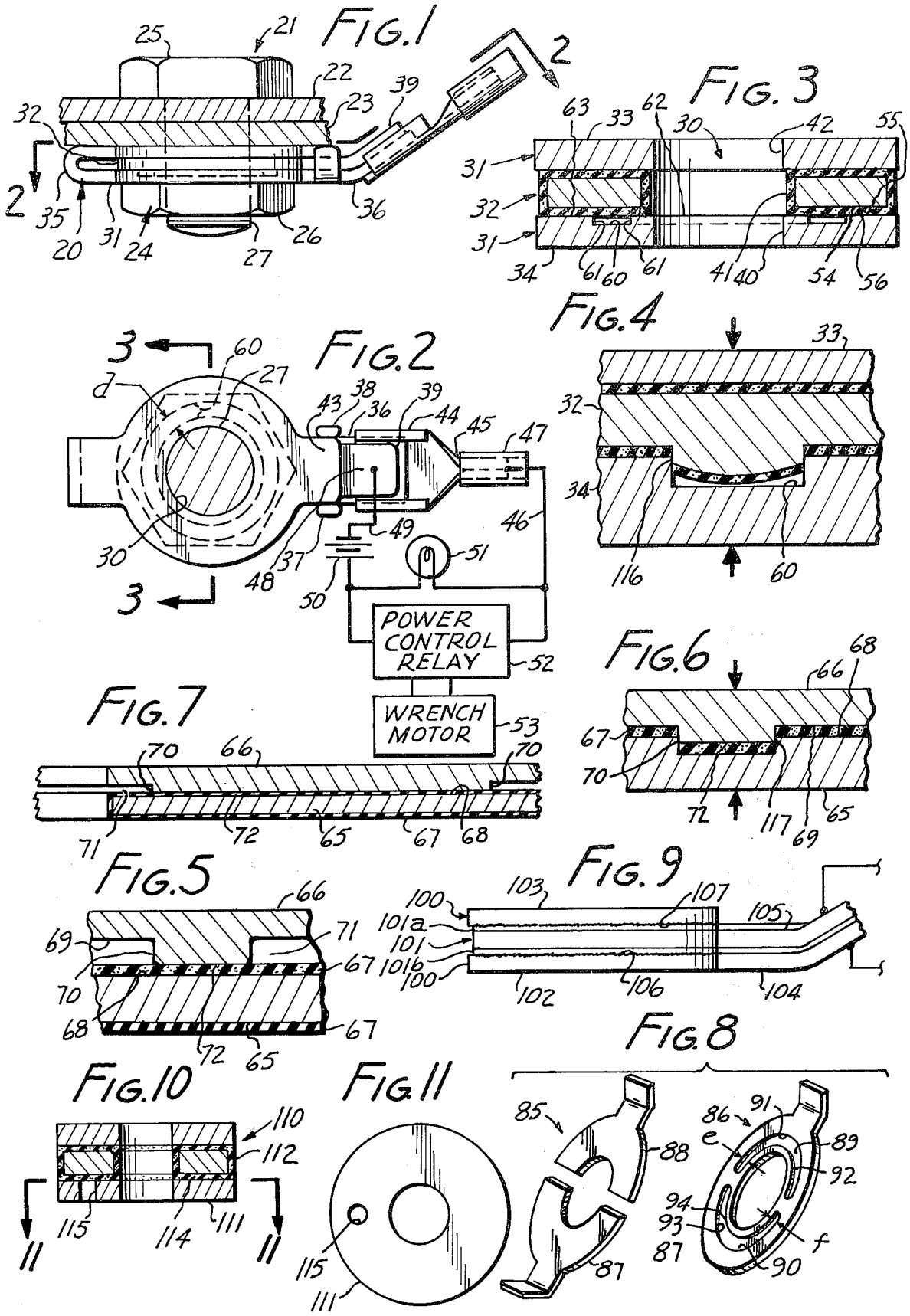
FIG. 1 is a side elevation of the presently-preferred embodiment of the invention in use with a fastener system to form a joint.
FIG. 2 is a cross-section taken at line 2—2 of FIG. 1.
FIG. 3 is a cross-section taken at line 3—3 of FIG. 2.
FIG. 4 is a fragmentary portion of FIG. 3 in another operating condition.
FIGS. 5 and 6 are fragmentary views of two sequential positions of another embodiment of the invention.
FIG. 7 is a fragmentary view of a portion of FIG. 6 closer to actual scale.
FIG. 8 is an exploded view of portions of still another embodiment of the invention.
FIG. 9 is a side elevation showing an alternate means of assembling some of the components of the invention.
FIG. 10 is an axial cross-section of yet another embodiment of the invention.
FIG. 11 is a cross-section taken at line 11—11 of FIG. 10.

The presently-preferred embodiment of the invention is shown in FIG. 1, wherein a device 20 is shown installed in a joint 21 shown as being formed of a pair of workpieces 22, 23, together with a tension-type fastener 24. The fastener comprises a headed bolt 25 and a nut 26 that is threadedly engaged to the shank 27 of the bolt. A pair of sheets is given as a single example of a workpiece. It could instead comprise a parent body with another body joined to it, or any other element or combination of elements which a tension-type fastener is used to join.

Device 20 is formed in the shape of a washer having a hole 30 (FIG. 3) therethrough. The wall of the hole 30 makes a close, but not necessarily an engaging, fit with the wall of the shank which passes through it.

The device includes a first member 31 and a second member 32, both of which are metallic and electrically conductive. The first member 31 is folded so as to form a pair of plates 33, 34 connected by a bight 35. Plate 34 also includes a tongue 36 with a pair of turned-up anti-rotation ears 37, 38. The second member 32 also includes a tongue 39, the two tongues comprising means for connecting the device to electrical circuit means. It will be observed that the second member is sandwiched between the two plates, these plates having aligned apertures 40, 41, 42 to form hole 30. Tongue 39 is located between ears 37 and 38, but does not contact them. There is also a tongue 43 on plate 33. The plates are held against rotation relative to one another by the ears and bight 35.

As best shown in FIG. 2, tongue 36 is embraced by a terminal clip 44 that has a neck 45 to which an electrical lead 46 can be connected. An insulator sleeve 47 surrounds the neck and shields it and the exposed end of the lead. The tongue 39 includes a portion 48 of bare metal, to which a lead 49 can be attached, such as by a clip (not shown) coaxial with, mounted to, and held by, sleeve 47, to form a second connection for a circuit to be made through the device.

An example of a suitable circuit which can be used with the device of FIG. 1 is shown in FIG. 2. A battery 50, or other source of electrical power, is connected across the two leads. An indicator lamp 51, which will light up when the circuit is complete, and a power control relay 52, which controls application of power to a wrench motor 53 adapted to drive a wrench for setting the fastener to a pre-selected axial preload, are connected in the circuit.

The power control relay may be one which is latched to a power-conducting condition, but which will shift to a non-conducting condition and cause the interruption of power to the wrench motor when a circuit is completed through the device. Power control relays and latch circuits are well known and are therefore not shown in detail in this specification. The purpose of device 20 is to permit an indication, such as by way of a lamp, to indicate the attainment of a desired axial preload, or to control a motor driving a wrench which is used to torque the fastener, by interrupting power to the driver when the desired axial preload is attained.

As is best shown in FIG. 3, second member 32 is sandwiched between the two plates. Importantly, it faces plate 34 (part of the first member), and this is the interface where the change in condition occurs. Second member 32 has a second substantially planar face 54 which faces toward a first substantially planar face 55 on first member 31 (on plate 34). A flat insulation layer 56 is located between the first and the second faces. When the first member is formed with two plates, the insulation layer will be placed between both plates 33 and 34 and the second member 32. The insulation layer electrically insulates the members from one another until after the device has changed condition. The insulation layer may conveniently completely encase the second member in the form of a hard shell.

The necessary property of the insulation layer for any combination of materials is that it be hard and brittle, so it will crack (fracture) abruptly. A suitable hardness for the material is 87C on the Rockwell scale, which is the approximate hardness of hard anodizing. Hard anodizing integrally formed on an aluminum alloy second member is the preferred construction. The insulation layer is not intended to have any substantial shear strength, but it is brittle and readily fractures under circumstances yet to be described. On the other hand, it does have substantial compressive stability. Various epoxy compounds, some paints, ceramics and fused glasses are also suitable for the insulation layer. The ceramics and glass are primarily suited for use on iron alloys, because anodizing is so very useful with aluminum. In any event, the layer is made of such a material and in such thickness as to insulate the first and second members from each other sufficiently to prevent the flow of current from one to another and to perform a structural function yet to be described.

As will further be discussed below, the first member is made of material harder and less ductile than that of the second member.

A pair of walls 61 recede from the first face at an angle thereto, and at least partially define an open region (a circular peripheral groove in FIG. 3) adjacent to the first face. The first face in FIG. 3 is the entire surface on each side of region 60, and the groove is formed in Plate 34.

As stated above, the first member will be made of material which is harder and less ductile than the material of which the second member is made. The harder member is preferably made of heat-treatable steel, because then its hardness can closely and routinely be controlled. The second member may be made of soft aluminum, or other conductive metal which is softer than the steel, and this is the preferred combination of material for most usages. When the second member is made of aluminum, the insulation layer is preferably hard anodizing, which is conveniently formed in place and is, therefore, unitary with the second member and also adherent thereto. Another example of suitable materials is to provide the harder member of a heat-treatable, heat-treated steel, and the more ductile member of a mild steel which is more ductile than the steel of which the harder member is made. The insulation layer can be made of a ceramic or of a fused glass applied to the face of the second member. This embodiment is suitable for higher temperature applications than the steel aluminum combination. In all embodiments, the members themselves are electrically conductive and are electrically insulated from each other by the insulation layer. The insulation layer may be considered as placed or located between them, even though it may be unitary with one of them.

In use, the illustrated device is used as a washer. It is placed between the nut and the workpiece or workpieces. The shank of the bolt passes through it. Of course, other shapes can be utilized, for the device, and the first member can even constitute the parent material of a workpiece abutted by a second member which carries the insulation layer. The washer embodiment is provided merely to show the best known, and what is expected to be the most common use for the invention. Also, the device can function to indicate loads even when it is not provided with an aperture to pass the shank of a fastener.

Another embodiment of the invention is shown in FIGS. 5 and 6, wherein a second member 65 and a first member 66 are shown. The second member may be made of a softer, more ductile, material, perhaps aluminum, than the first member which may be made of heat-treatable steel and is harder and less ductile than the material of the second member. A substantially flat insulation layer 67 may be placed on the "second" substantially planar face 68 of second member 65 and has the same properties as the insulation layers heretofore described. The insulation layer faces a "first" substantially planar face 72 on the first member 66. A pair of walls 70 recedes at an angle from the first face, partially defining an open region 71 adjacent to the first surface. More specifically, the open region is the space surrounding the rise-like, ring-shaped body defined by the walls. Surface 69 on the first member is recessed, or offset, from face 72.

FIG. 7 illustrates that the amount of offset of face 72 from surface 69, and the thickness of the insulation layer are quite small in a practical device. In FIG. 3 the "offset" is in a groove, providing relief for movement of material into the groove. In FIG. 7 the "offset" is the height of a rise, permitting the insertion of a rise into the other material. Some of the dimensional considerations of the device of FIG. 3 are shown in FIG. 2. The walls have inside and outside segments which are spaced apart by a width *d* (FIG. 2).

FIG. 8 shows a second and a first electrically conductive member 85, 86 which may be utilized in place of the same members in FIG. 1, but in which the second member is divided into two sections 87, 88. It is as before made of softer, more ductile material than the first member. The first member has a pair of regions 89, 90, each adjacent to a first substantially planar face, and aligned with a respective one of the two sections. The sections are spaced apart from one another. The regions 89 and 90 are bounded by walls receding from the first face having respective segments 91, 92 and 93, 94, which are spaced apart by different widths *e, f.* As a consequence, there is a different span across each of these, and as will later be seen, each is respective to a different load to be sensed by the device. FIG. 9 is a modification of FIG. 1 wherein the bight is eliminated, but the same members are otherwise provided, namely a first and a second member 100, 101, member 100 being made of plates 102, 103. The members have respective tongues 104, 105 for the purposes aforesaid. The distinction between this construction and the construction of FIG. 1 is that, instead of being mechanically joined together, the device is held together by thin films of cement 106, 107, which serves to lighten the device. The film may be of nearly molecular thickness, and is made as thin as possible in order that it will not interfere with electrical conductivity through the device when it is in its conducting condition. In fact, an electrically conducting cement can be used.

It will be understood that the top portion of the first member in both FIGS. 1 and 9 may be eliminated, if desired, and the load can be applied directly to the second member and the bottom of the first member, as desired.

FIGS. 10 and 11 show still another embodiment of a device 110 according to the invention, wherein a first and a second member 111, 112 are provided with substantially the same characteristics as the first and second members in FIG. 1. Its scale has been foreshortened in the horizontal dimension. The entire construction may be cemented together as in FIG. 9 or may be mechanically connected as in FIG. 1. The same insulation layer 114 is provided on the second member as in the embodiment of FIG. 1. The region 115 in the device of FIG. 10 constitutes a hole extending entirely through the plate, which is a convenient form of offset region which may readily be reproduced to close tolerances in production operations.

The purpose of FIGS. 10 and 11 is to show that there is a wide range of shapes which can be utilized for the region, and that the region need not be fully peripheral, nor even of any unique shape.

In operation, the device 20 of FIG. 1 is shown placed like a washer between the nut and the workpieces, and torque is applied so as to place the shank of the fastener in axial tension. The effect of this is to compress the device together as a sandwich and tends to move the members "toward" each other. Evidently the axial movement will be very small because the device is an integral sandwich. The term toward is used to connote the application of a force compressing the members toward one another and against the insulation layer. Until a critical level is reached, which is determined by the relative physical properties and dimensions of the members and of the insulation layer, the device tends to remain as illustrated in FIG. 3, with the two members fully insulated from one another by the insulation layer. The faces are devoid of piercing members in all embodiments, and their opposed planar areas tend to act as "hold-off" means, so that substantial relative axial movement must await the fracture of the insulation layer. As shown in FIG. 4, when the predetermined preload is reached in the device of FIG. 3, then the brittle insulation layer is abruptly cracked (fractured) at the wall, and that portion of the insulation material which is within the boundary is moved in a shear like movement, and the material of second member enters the other (in the device of FIGS. 1–4 the more ductile material extrudes into the discontinuity in the harder member) until some insulation-free material of each member is exposed to and in contact with insulation-free material of the other, such as at point 116 of contact. Point 116 is at or adjacent to the boundary, whereupon a complete electrical circuit can be made between the two members. The circuit is completed through this metal-to-metal contact. This is a one-shot, irreversible change of conducting condition.

The operation of the device of FIG. 5 is analogous. Initially, and until the predetermined load is reached, the two members will simply be pressed together, as in FIG. 5, with the faces acting as hold-off means, and the members will remain insulated from one another. However, when the ultimately desired preload is reached, the situation of FIG. 6 occurs wherein the abrupt cracking of the insulation layer, which is formed of harder and less ductile material than the material of the second member, has entered the second member by displacing a more ductile material of the second member. At a point 117 at the wall, insulation-free material of the members makes contact to complete the circuit.

The operation of the device of FIG. 8 is similar to that of FIG. 1, except that, because of the difference of spacing between segments of the walls, there will be an earlier closure of contact circuit through the device with the wider spacing than with less spacing. Accordingly, it is possible to use the same device to indicate two different levels which, of course, will occcur at different times in the tightening procedure.

The device of FIG. 10 functions precisely as that in FIG. 1, except that the material of the second member will tend to extrude into a hole of the first member instead of into a ring-shaped structure.

As can be seen in FIGS. 1–4, movement of metal to make the desired electrical contact occurs by extrusion. In FIGS. 5 and 6, it occurs by displacement. There is, of course, some lateral movement of the softer material as a consequence of "squashing", but this is negligible, because the materials are selected for functioning primarily in the manner illustrated. It will be observed that the insulating layer extends beyond the wall and over the open region to provide an insulating effect and an area wherein the cracking occurs.

The tongues and ears, the cement layer, and whatever other means is used to hold the plates against rotation is sometimes referred to as "anti-rotation means".

When the second member is sandwiched between two plates, such as between plates 33 and 34, the plate facing the insulation layer is referred to as the first member (for example plate 34) and first the other, for example plate 33 is referred to as a "third member".

All of these illustrated constructions can readily be manufactured in routine manufacturing operations to a high degree of precision and repeatability. The device can function as a washer and is in every way reliable. The closure of the circuit can be indicated by an indicator means, such as a lamp, or can be utilized to terminate the operation of a wrench motor, all as preferred.

The precise point at which the device will perform to make an electrical contact can be altered from device to device by dimensional changes of either the opposed areas of the faces, the thickness of the plates relative to one another, the relative hardness of the materials, or the properties of the insulation layer, or a combination of them.

The term "layer" as it refers to the insulation layer is broadly used to connote a shield which protects one surface from another. It can be applied as a coating, or formed in place from the material of one of the members. When it is made of hard anodizing, for example, the layer may even both extend into its surface and project from it, because it is an oxide of the material formed in place.

In all embodiments, the wall is formed on the member having the greater hardness and lesser ductility.

When a film of cement is used, it must be so thin and preferably brittle that it will not impede electrical conductivity through the device.

A set of dimensions suitable for use with a ⅜ inch bolt to indicate the exertion of 4,500 lbs. of axial preload is as follows:

Diameter of hole 30: ⅜ inch
Outer diameter of member 31: 9/16 inch
Outer diameter of member 32: 9/16 inch Inside diameter of member 32: sufficiently less than hole diameter to give bolt clearance from hard anodizing.

The thickness of the anodizing in FIG. 3 is greatly exaggerated relative to all other dimensions.

Width *d* of groove 60: 0.060 inches

Inside diameter of groove 60: 0.470 to 0.475 inches

Depth of groove 60: at least 0.006 inches, preferable 0.010 or greater Thickness of insulation layer 56: about 0.002 inch Thickness of member 31: 0.032 inch Thickness of member 32: 0.025–0.030 inch Material of member 31, steel heat treated to about Rockwell 35C.

Material of member 32, aluminum alloy 6061, one-half hard, coated with hard anodizing.

Suitable dimensions for other embodiments of the invention can readily be produced from the foregoing specification and example by persons skilled in the art, with only routine investigation to determine the dimensions for any individual desired preload.

This invention is not to be limited by the embodiments shown in the drawings and described in the description, which are given by way of example and not of limitation, but only in accordance with the scope of the appended claims.

We claim:

1. A one-shot compressive-load sensitive electrical circuit element which changes from an electrically non-conductive condition to a conductive condition when a compressive load of predetermined magnitude is applied thereto, comprising: a first and a second electrically conductive metallic member, the first of said members being made of material which is harder and less ductile than the material of the second member, a first substantially planar face on the first member, a second substantially planar face on the second member, a wall receding from the first planar face at an angle thereto, said wall at least partially defining an open region adjacent to the first face, a substantially flat insulation layer between the faces, the faces being opposed to and facing one another across the insulation layer, and being contiguous thereto, the faces being the closest portions of the members to one another so as to function to hold the members apart in a compressive substantially non-yielding stack while the insulation layer remains unbroken at said second planar face adjacent to the wall, and said insulation layer extending beyond the wall and over the open region, the material of the insulation layer being hard and brittle, and of such thickness that, when the members are pressed toward each other by a compressive load, the insulation layer remains unbroken until said predetermined load, whose magnitude depends at least in part on the physical strength of the insulation layer, is applied, whereupon the insulation layer abruptly fractures adjacent to the wall, and a portion of one of the members moves axially toward the other member, displacing in a shear-like axial movement that portion of the insulation layer which is bounded by the wall, whereby to bring insulation-free metal of both members into contact with each other and thereby to make an electrically conductive contact as a consequence of the application of said load, said members being adaptable to connection into an electrical circuit.

2. A circuit element according to claim 1 in which the wall bounds a rise on the first member, and the open region surrounds the rise.

3. A circuit element according to claim 1 in which the second member comprises an annular ring completely coated with the insulation layer.

4. A circuit element according to claim 1 in which the members are made of steel, and in which the insulation layer comprises a ceramic or glass applied to the second face.

5. A circuit element according to claim 1 in which the wall defines an arcuate groove in the first member, and in which the first member is annular.

6. A circuit element according to claim 1 in which there is a plurality of spaced-apart first and second members, pairs of walls on respective first members being spaced apart by different widths, whereby conductive contacts are made at different compressive loads.

7. A circuit element according to claim 1 in which the insulation layer is adherent to or integral with the second face.

8. A circuit element according to claim 1 in which the members are annular, having a hole therethrough to pass the shank of a tension-type fastener, thereby also acting as a washer.

9. A circuit element according to claim 1 in which connector means is formed on each of said members for connection to electrical circuit means.

10. A circuit element according to claim 1 in which the element is cemented together.

11. A circuit element according to claim 1 in which the element is mechanically held together.

12. A circuit element according to claim 1 further including connector means for connecting the members into an electrical circuit.

13. A circuit element according to claim 1 in which the open region defined by the wall comprises a recess in the first member.

14. A circuit element according to claim 13 in which the recess is a hole through the first member.

15. A circuit element according to claim 1 which the material of the second member comprises aluminum, and the material of the insulation layer comprises hard anodizing formed integrally on the second face.

16. A circuit element according to claim 15 in which the members are ring-shaped.

17. A circuit element according to claim 16 in which the hard anodizing entirely covers the second member.

18. A circuit element according to claim 16 further including connector means for connecting the members into an electrical circuit.

19. In combination: a circuit element according to claim 1; and electrical circuitry means responsive to electrical conduction through said device and to lack thereof.

20. A combination according to claim 19 in which the electrical circuitry means includes an indicating lamp.

21. A combination according to claim 19 in which the electrical circuitry means includes power control means to disable a motor when a pre-selected preload is exerted on the device.

22. A circuit element according to claim 1 in which anti-rotation means restrains the first and second members from rotation relative to one another.

23. A circuit element according to claim 22 in which the anti-rotation means comprises interengaging members on said members.

24. A circuit element according to claim 23 in which said interengaging members comprise tongues projecting from the members.

25. A circuit element according to claim 1 in which a third member bears against the second member on the opposite side of the second member from the first member to sandwich the second member between the first and third members.

26. A circuit element according to claim 25 in which the third member is a plate.

* * * * *

UNITED STATES PATENT OFFICE

CERTIFICATE OF CORRECTION

Patent No. 3,945,704 Dated June 25, 1976

Inventor(s) ROBERT A. KRAUS ET AL

It is certified that error appears in the above-identified patent and that said Letters Patent are hereby corrected as shown below:

| | |
|---|---|
| Abstract | after "purposes.", change "26 Claims" to --25 Claims-- |
| Col. 5, line 31 | insert quotation marks around "toward" |
| Col. 6, line 8 | "less" should read --the lesser-- |
| Col. 7, lines 4-5 | "The...dimensions." should follow "anodizing" in line 3 |
| Col. 7, line 8 | "preferable" should read --preferably-- |
| Col. 7, lines 15-16 | "one-half" should read --1/2-- |
| Col. 8, lines 57-60 (Claim 21) | Canceled, non-elected, see Response dated 12/24/74 and Office action dated 3/13/75 |

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*